US010369676B2

(12) United States Patent
Park

(10) Patent No.: US 10,369,676 B2
(45) Date of Patent: Aug. 6, 2019

(54) CHEMICAL MECHANICAL POLISHING APPARATUS

(71) Applicant: Samsung Electronics Co., Ltd., Suwon-si, Gyeonggi-do (KR)

(72) Inventor: Kyutae Park, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 154 days.

(21) Appl. No.: 15/593,779

(22) Filed: May 12, 2017

(65) Prior Publication Data

US 2018/0009078 A1 Jan. 11, 2018

(30) Foreign Application Priority Data

Jul. 6, 2016 (KR) ..... 10-2016-0085648

(51) Int. Cl.

| | |
|---|---|
| ***B24B 37/34*** | (2012.01) |
| ***B24B 57/02*** | (2006.01) |
| ***B24B 37/20*** | (2012.01) |
| ***B24B 37/10*** | (2012.01) |

(52) U.S. Cl.

CPC ..... *B24B 37/20* (2013.01); *B24B 37/107* (2013.01); *B24B 37/34* (2013.01); *B24B 57/02* (2013.01)

(58) Field of Classification Search

CPC ..... B24B 37/04; B24B 37/34; B24B 57/00; B24B 57/02

See application file for complete search history.

(56) References Cited

U.S. PATENT DOCUMENTS

| | | | | |
|---|---|---|---|---|
| 3,747,284 | A * | 7/1973 | Lyczko | B24B 55/02 409/136 |
| 4,776,515 | A * | 10/1988 | Michalchik | A61L 9/14 239/3 |
| 4,801,086 | A * | 1/1989 | Noakes | B05B 5/0255 239/3 |
| 5,165,601 | A * | 11/1992 | Rodenberger | B05B 5/0255 239/3 |
| 6,105,571 | A * | 8/2000 | Coffee | A61M 15/0091 128/200.14 |
| 6,284,091 | B1 | 9/2001 | Wong | |
| 6,576,552 | B2 | 6/2003 | Kojima et al. | |
| 6,767,124 | B2 | 7/2004 | Shikami et al. | |

(Continued)

FOREIGN PATENT DOCUMENTS

| | | |
|---|---|---|
| JP | 3083288 B2 | 9/2000 |
| JP | 2001-160545 A | 6/2001 |

(Continued)

*Primary Examiner* — Timothy V Eley

(74) *Attorney, Agent, or Firm* — Harness, Dickey & Pierce, P.L.C.

(57) ABSTRACT

Disclosed is a chemical mechanical polishing apparatus. The chemical mechanical polishing apparatus comprises a lower base, a platen configured to rotate and provided on a top surface of the lower base, a polishing pad on the platen; and at least one slurry supply device that is disposed adjacent to the polishing pad and supplies a slurry to the polishing pad. The slurry supply device comprises a capillary nozzle that is disposed over the polishing pad and includes a pin-type conductive tip therein, a slurry supply unit that supplies the slurry into the capillary nozzle, and a voltage supply unit that applies a voltage to the pin-type conductive tip.

20 Claims, 12 Drawing Sheets

(56) References Cited

U.S. PATENT DOCUMENTS

| | | | | |
|---|---|---|---|---|
| 8,235,506 | B2 * | 8/2012 | Nishio | B05B 5/0255 347/55 |
| 8,562,095 | B2 | 10/2013 | Alleyne et al. | |
| 8,878,642 | B2 * | 11/2014 | Ueno | H01F 1/24 336/233 |
| 9,150,020 | B2 * | 10/2015 | Lee | B41J 2/06 |
| 2002/0022441 | A1 | 2/2002 | Sugai | |
| 2003/0211743 | A1 | 11/2003 | Chang et al. | |
| 2007/0017505 | A1 * | 1/2007 | Lipp | A61M 15/02 128/200.16 |
| 2010/0240283 | A1 | 9/2010 | Nemoto et al. | |
| 2014/0261824 | A1 | 9/2014 | Byers et al. | |
| 2015/0117135 | A1 | 4/2015 | Chen et al. | |
| 2018/0033656 | A1 * | 2/2018 | Fukushima | H01L 21/6715 |

FOREIGN PATENT DOCUMENTS

| | | | |
|---|---|---|---|
| KR | 10-0323065 | B1 | 2/2002 |
| KR | 2005-0065752 | A | 6/2005 |

* cited by examiner

CHEMICAL MECHANICAL POLISHING APPARATUS

CROSS-REFERENCE TO RELATED APPLICATIONS

This U.S. nonprovisional patent application claims priority under 35 U.S.C § 119 of Korean Patent Application 10-2016-0085648 filed on Jul. 6, 2016, the entire contents of which are hereby incorporated by reference.

BACKGROUND

The inventive concepts relate to a chemical mechanical polishing apparatus and, more particularly, to a chemical mechanical polishing apparatus equipped with a slurry supply device that electro-hydrodynamically supplies slurry, electrically charging the slurry as the slurry is being dispensed.

A semiconductor device is generally composed of a plurality of circuit patterns stacked on a wafer by performing selectively and repeatedly processes such as photolithography processes, etch processes, ion implantation processes, diffusion processes, deposition processes, and/or other unit processes. In manufacturing the semiconductor device, circuit patterns follow the trend of high integration such that a line width is being continuously decreased and more overlay is preferred between circuit patterns of stacked layers. When the circuit patterns are formed on the layers, a surface of the wafer may become irregular and then this irregular surface may induce process failures such as alignment errors in a photolithography process. The wafer may thus experience planarization processes on its target surface at the time between unit processes.

Various methods are proposed to planarize the target surface of the wafer, and from which a chemical mechanical polishing (referred to as hereinafter CMP) is widely used. It is important to supply an appropriate amount of slurry in order to stably carry out the CMP process.

SUMMARY

Example embodiments of the inventive concepts provide a chemical mechanical polishing apparatus equipped with a slurry supply device that supplies an appropriate amount of slurry to a polishing pad.

An object of the inventive concepts is not limited to the above-mentioned, and other objects which have not been mentioned above will be clearly understood to those skilled in the art from the following description.

According to example embodiments of the inventive concept, a chemical mechanical polishing apparatus may comprise: a lower base; a platen configured to rotate and provided on a top surface of the lower base; a polishing pad on the platen; and at least one slurry supply device that is disposed adjacent to the polishing pad and supplies a slurry to the polishing pad. The slurry supply device may comprise: a capillary nozzle that is disposed over the polishing pad and includes a pin-type conductive tip therein; a slurry supply unit that supplies the slurry into the capillary nozzle; and a voltage supply unit that applies a voltage to the tip.

According to example embodiments of the inventive concept, a chemical mechanical polishing apparatus may comprise: a lower base; a platen configured to rotate and provided on a top surface of the lower base; a polishing pad on the platen; and at least one slurry supply device adjacent to the polishing pad. The at least one slurry supply device may includes: a capillary nozzle over and spaced apart from the polishing pad; a slurry supply unit configured to supply the slurry into the capillary nozzle; and a voltage supply unit configured to apply a voltage to the capillary nozzle. The capillary nozzle may be configured to electro-hydrodynamically spray the slurry out of the capillary nozzle.

According to example embodiments of the inventive concept, a slurry supply device for supplying slurry onto a polishing pad may comprise: a capillary nozzle including a pin-type conductive tip and a jetting hole, the jetting hole over and spaced apart from a polishing pad by between 2 cm to 9 cm; a slurry supply unit configured to supply slurry into the capillary nozzle; and a voltage supply unit configured to apply a voltage to the pin-type conductive tip.

Details of other example embodiments are included in the description and drawings.

DETAILED DESCRIPTION OF EXAMPLE EMBODIMENTS

Figure 1:
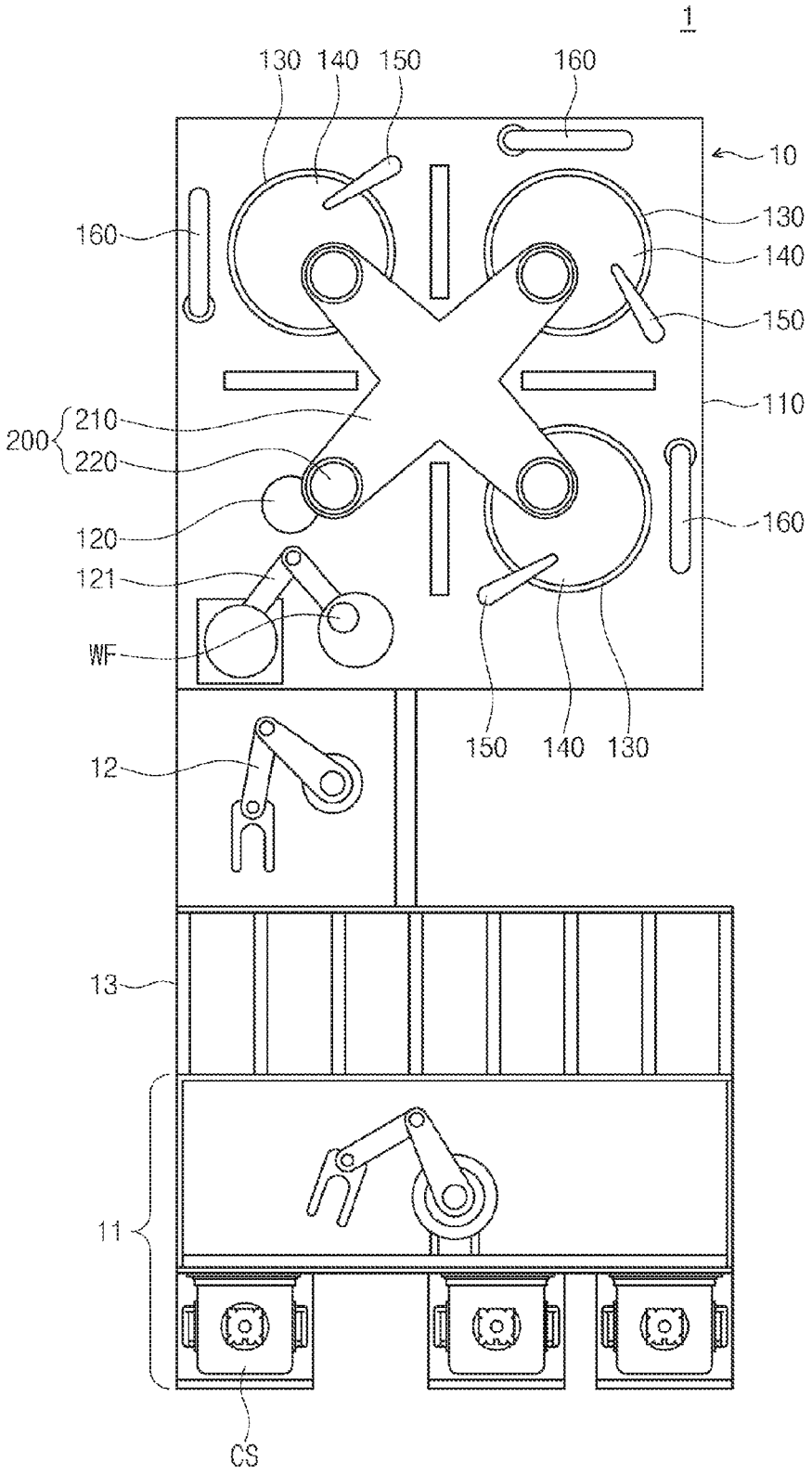
FIG. 1 is a plan view for explaining a chemical mechanical polishing equipment according to example embodiments of the inventive concepts.

FIG. 1 is a plan view for explaining a chemical mechanical polishing equipment according to example embodiments of the inventive concepts.

Referring to FIG. 1, a chemical mechanical polishing equipment 1 may include a chemical mechanical polishing apparatus 10, an index section 11, a transfer robot 12, and a cleaning apparatus 13.

The index section 11 may provide a space for placing a cassette CS in which wafers WF are stored. The index section 11 may transfer the wafer WF in the cassette CS into the transfer robot 12 and/or provide the cassette CS with the wafer WF that has experienced a polishing process.

The transfer robot 12 may be disposed between the index section 11 and the chemical mechanical polishing apparatus 10, and may transfer the wafer WF therebetween.

The chemical mechanical polishing apparatus 10 may polish the wafer WF transferred through the transfer robot 12. The chemical mechanical polishing apparatus 10 may include a lower base 110, a load cup 120, a platen 130, a polishing pad 140, a pad conditioner 160, a slurry supply device 150, and a carrier head assembly 200. Details about these items will be further discussed below with reference to FIG. 2.

The cleaning apparatus 13 may be disposed between the index section 11 and the transfer robot 12. The load cup 120 may receive the wafer WF that has been polished in the chemical mechanical polishing apparatus 10, and the transfer robot 12 may transfer the wafer WF into the cleaning apparatus 13. The cleaning apparatus 13 may clean pollutions remaining on the wafer WF. The cleaned wafer WF may be carried into the index section 11 and then stored in the cassette CS. Thus, the polishing process on the wafer WF may be terminated.

Figure 2:
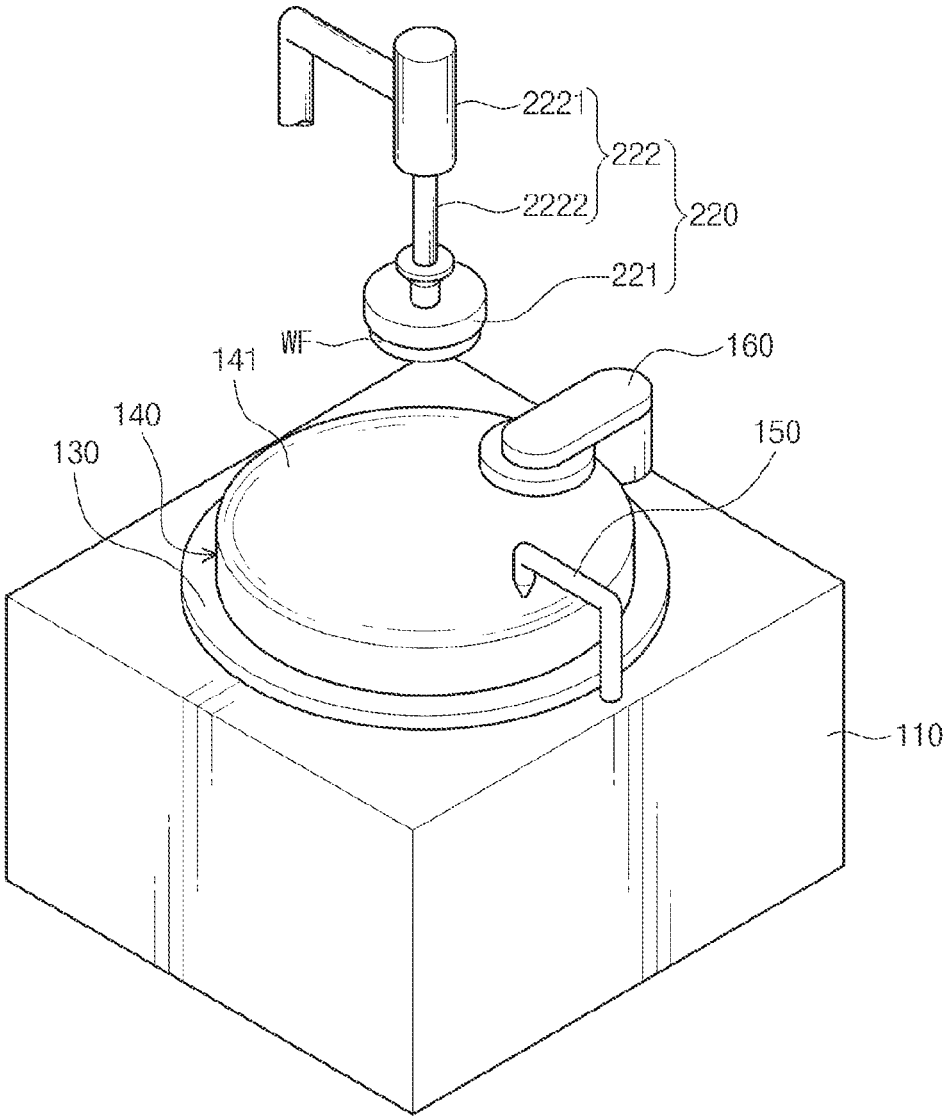
FIG. 2 is a perspective view illustrating a portion of a chemical mechanical polishing apparatus of FIG. 1.

FIG. 2 is a perspective view illustrating a portion of a chemical mechanical polishing apparatus of FIG. 1.

Referring to FIGS. 1 and 2, the lower base 110 may constitute a lower structure of the chemical mechanical polishing apparatus 10. The lower base 110 may support the load cup 120, the platen 130, the polishing pad 140, the pad conditioner 160, and the slurry supply device 150. In other words, the load cup 120, the platen 130, the polishing pad 140, the pad conditioner 160, and the slurry supply device 150 may be disposed on a top surface of the lower base 110.

The load cup 130 may provide a space in which the wafer WF temporarily stands by. The load cup 120 may be disposed adjacent to the transfer robot 12.

An exchanger 121 may be provided between the load cup 120 and the transfer robot 12, and may provide the load cup 120 with the wafer WF transferred from the index section 11 through the transfer robot 12.

The platen 130 may be provided configured to rotate on the top surface of the lower base 110. For example, the platen 130 may receive a rotational force from a motor (not shown) disposed in the lower base 110. The platen 130 may thus rotate around an imaginary rotation axis (not shown) perpendicular to a top surface of the platen 130. The imaginary rotation axis may be perpendicular to the top surface of the lower base 110. The platen 130 may be provided in single or plural on the top surface of the lower base 110. In some embodiments, the platen 130 may be provided in plural. The plurality of platens 130 and the load cup 120 may be disposed spaced apart from each other at a predetermined, or alternatively desired, angle around a center of the lower base 110.

The platen 130 may support the polishing pad 140 disposed on the top surface thereof. The polishing pad 140 may rotate together with the platen 130. The polishing pad 140 may be provided as a plate having a predetermined, or alternatively desired, thickness. In some embodiments, the polishing pad 140 may be provided a circular plate, but the inventive concepts are not limited thereto.

Figure 3A:
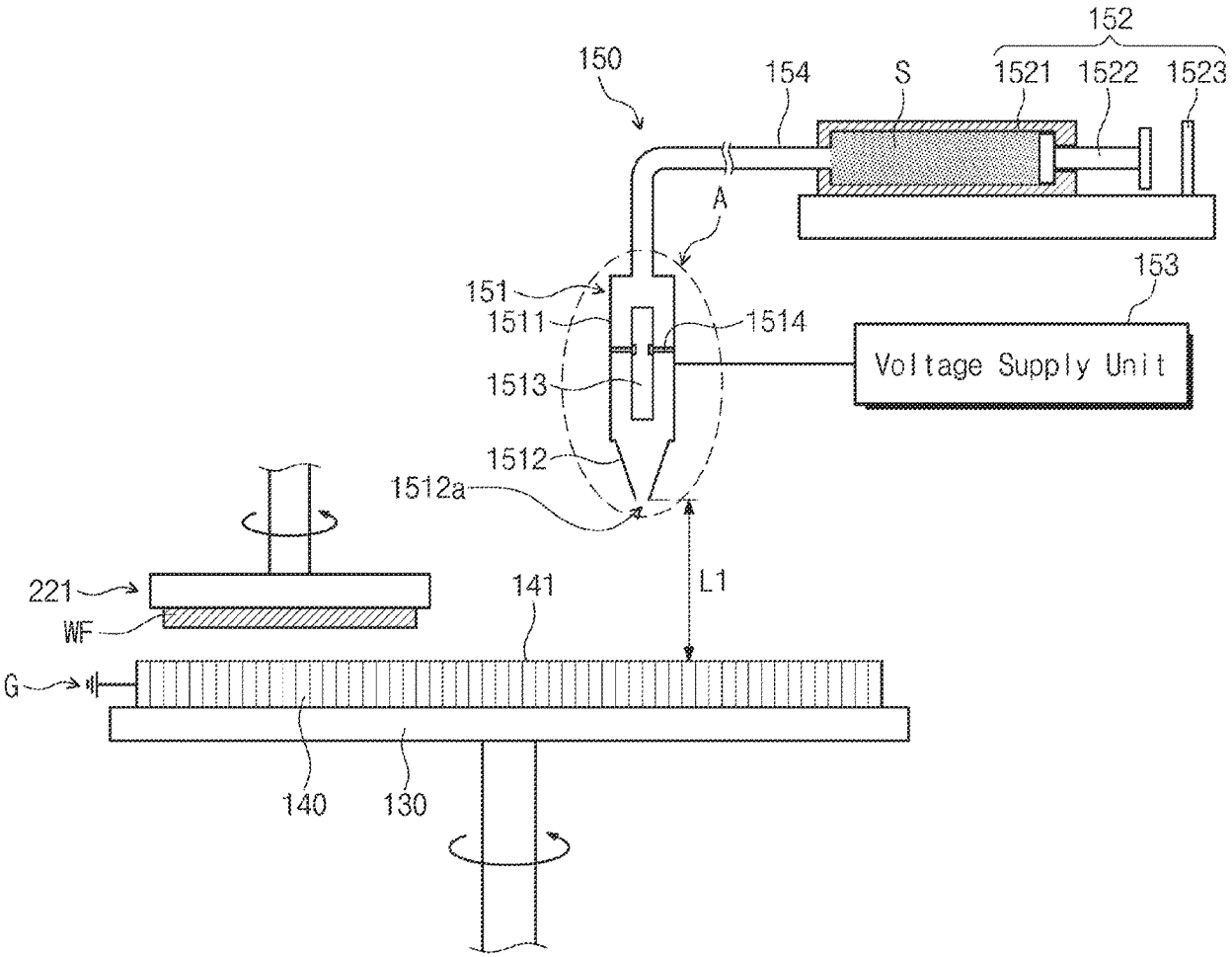
FIG. 3A is a schematic diagram for explaining a slurry supply device of FIG. 2.

The polishing pad 140 may include a rough polishing surface. The polishing surface may thus mechanically polish the wafer WF while directly contacting the wafer WF. In some embodiments, the polishing surface may be a top surface 141 of the polishing pad 140. The polishing pad 140 may include a porous material (e.g., polyurethane) having a plurality of microspaces. The microspaces of the polishing pad 140 may receive slurry for chemically mechanically polishing the wafer WF. In some embodiments, the polishing pad 140 may be conductive. Alternatively, in other embodiments, the polishing pad 140 may be insulative. In case that the polishing pad 140 is conductive, the polishing pad 140 may be earthed to a ground G or the like as illustrated in FIG. 3A. It therefore may be possible to hinder or prevent occurrence of short circuit.

The pad conditioner 160 may be disposed adjacent to the polishing pad 140. The pad conditioner 160 may keep the polishing surface of the polishing pad 140 in a satisfactory state to effectively polish the wafer WF during the polishing process.

The slurry supply device 150 may be disposed adjacent to the polishing pad 140. The slurry supply device 150 may provide a slurry to the polishing pad 140. The slurry may include a reactive agent (e.g., deionized water for oxidation polishing), abrasive particles (e.g., silicon dioxide for oxidation polishing), and a chemical reaction catalyst (e.g., potassium hydroxide for oxidation polishing). Details about the slurry supply device 150 will be further discussed below with reference to FIG. 3A.

The carrier head assembly 200 may be disposed over the lower base 110. The carrier head assembly 200 may include an upper base 210 that is configured to rotate and provided over the lower base 110 and a wafer pick-up section 220 that can pick up the wafer WF.

The upper base 210 may provide an outward appearance of the carrier head assembly 200. In some embodiments, the upper base 210 may have but not limited to an intersecting shape (e.g., a cross shape or an X-type shape) formed by two elongated bars (not designated by the reference numerals) crossing each other. A driving mechanism (not shown) may be provided to drive the upper base 210 to rotate around an imaginary rotation axis. The imaginary rotation axis may go through a center of the upper base 210 and may be perpendicular to the top surface of the lower base 110.

The wafer pick-up section 220 may be provided on the upper base 210. In some embodiments, the wafer pick-up section 220 may be provided in plural. Each of wafer pick-up sections 220 may be adjacently disposed on end portions of the elongated bars constituting the upper base 210. The wafer pick-up sections 220 may be provided corresponding to the number of the platens 130 and the load cup 120. Each of the wafer pick-up sections 220 may include a carrier head 221 and a head rotation driving unit 222.

The carrier head 221 may adsorb the wafer WF in such a way that a polishing target surface of the wafer WF faces the polishing surface (or the top surface 141) of the polishing pad 141. The carrier head 221 may press the wafer WF against the polishing pad 140 during the polishing process. When the upper base 210 is rotated, the carrier head 221 may sequentially move from the load cup 120 into each of the platens 130. Each of the carrier heads 221 may load the wafer WF from the load cup 120 and then move into one or more platens 130 so as to polish the wafer WF. The carrier head 221 may also unload the polished wafer WF onto the load cup 120.

The head rotation driving unit 222 may drive to rotate the carrier head 221. The head rotation driving unit 222 may include a rotational motor 2221 and a rotating shaft 2222 that connects the rotational motor 2221 to the carrier head 221.

Figure 3B:
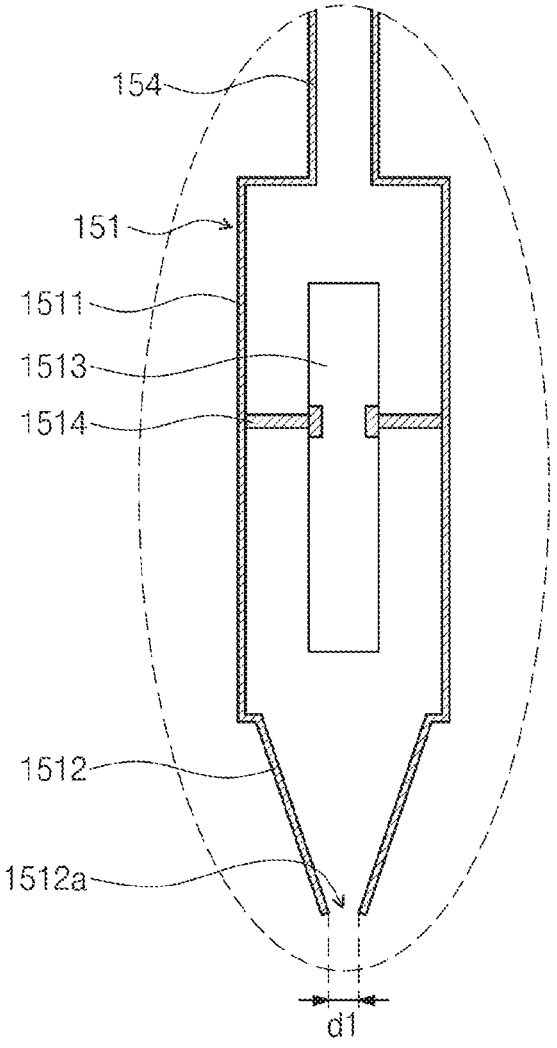
FIG. 3B is an enlarged view of section A shown in FIG. 3A.

FIG. 3A is a schematic diagram for explaining the slurry supply device of FIG. 2. FIG. 3B is an enlarged view of section A shown in FIG. 3A. The following description will be given under the assumption that the polishing pad 140 is conductive.

Referring to FIGS. 3A and 3B, the slurry supply device 150 may include a capillary nozzle 151, a slurry supply unit 152, and a voltage supply unit 153.

The capillary nozzle 151 may spray a slurry S on the polishing pad 140 that are rotating. The capillary nozzle 151 may be disposed over and spaced apart from the polishing pad 140. In some embodiments, a first spacing L1 may be between a bottom end of the capillary nozzle 151 and the top surface 141 of the polishing pad 140. The first spacing L1 may be in the range from about 2 cm to about 9 cm. The capillary nozzle 151 may be connected to the slurry supply unit 152 through an interconnect pipe 154. The capillary nozzle 151 may therefore be supplied with the slurry S from the slurry supply unit 152. The capillary nozzle 151 may include a body segment 1511, a nozzle segment 1512, and a tip 1513. The capillary nozzle 151 may further include a fixing member 1514.

The body segment 1511 and the nozzle segment 1512 may form an outward appearance of the capillary nozzle 151. The body segment 1511 may form a space for storing the slurry S therein. The tip 1513 may be disposed within the body segment 1511. In some embodiments, the body segment 1511 may be conductive. Alternatively, in other embodiments, the body segment 1511 may be insulative. The body segment 1511 may be electrically connected to the voltage supply unit 153. The body segment 1511 may have but not limited to a cylindrical shape. The interconnect pipe 154 may be connected to a top portion of the body segment 1511.

The nozzle segment 1512 may have a top portion connected to a bottom portion of the body segment 1511. In some embodiments, the body segment 1511 and the nozzle end segment 1512 may be integrally combined with each other. The nozzle segment 1512 may be provided to have a conical shape. For example, the nozzle segment 1512 may have an inner diameter which decreases with approaching the bottom end of the capillary nozzle 151. In some embodiments, the nozzle segment 1512 may be insulative. Alternatively, in other embodiments, the nozzle segment 1512 may be conductive.

The nozzle segment 1512 may include a jetting hole 1512*a* at its bottom end. The jetting hole 1512*a* may therefore be provided at the bottom end of the capillary nozzle 151. The jetting hole 1512*a* may have a circular shape. The jetting hole 1512*a* may have a diameter d1 in the range from about 10 nm to about 100 nm. When the diameter d1 of the jetting hole 1512*a* is less than about 10 nm, the jetting hole 1512*a* may be closed up by the slurry S sprayed therefrom. On the other hand, when the diameter d1 of the jetting hole 1512*a* is greater than about 100 nm, the capillary nozzle 151 may have a difficulty in electro-hydrodynamically spraying the slurry S. For example, when the diameter d1 of the jetting hole 1512*a* is greater than about 100 nm, the slurry S may not form a meniscus at the jetting hole 1512*a* which will be discussed below. In this case, the slurry S may be in a charged state. In some embodiments, the diameter d1 of the jetting hole 1512*a* may be, but not limited to, in the range from about 40 nm to about 50 nm. Here, "electro-hydrodynamically spraying" means that a voltage is applied to a fluid to charge it, and then an electric field is used to atomize and spray the fluid.

The tip 1513 may be disposed in the capillary nozzle 151. In detail, the tip 1513 may be disposed within the body segment 1511. The tip 1513 may have an elongated pin shape. The tip 1513 may be conductive. For example, the tip 1513 may include but not limited to a metal material. The tip 1513 may be electrically connected to the voltage supply unit 153 such that a voltage may be applied to the tip 1513 from the voltage supply unit 153. This will be further discussed in detail later.

The fixing member 1514 may fix the tip 1513 inside the capillary nozzle 151. The fixing member 1514 may connect the body segment 1511 to the tip 1513. For example, the fixing member 1514 may include an extension part (not designated by the reference numeral) that extends toward the tip 1513 from an inner surface of the body segment 1511 and a grip part (not designated by the reference numeral) that is disposed at an end of the extension part so as to grip the tip 1513. The inner surface of the body segment 1511 may be a surface facing the tip 1513. In some embodiments, the extension part may have but not limited to a bar shape. The fixing member 1514 may be conductive.

The slurry supply unit 152 may supply the slurry S to the capillary nozzle 151. As discussed above, the slurry supply unit 152 may provide the capillary nozzle 151 with the slurry S at a predetermined, or alternatively desired, flow rate. In some embodiments, the slurry supply unit 152 may supply the slurry S at a flow rate in the range, but not limited to, from about 2 μl/min to about 8 μl/min. The slurry supply unit 152 may include a syringe-shaped accommodating part 1521 that accommodates the slurry S, a piston part 1522 that is movably disposed in the accommodating part 1521, and a pressing part 1523 that presses the piston part 1522. The slurry supply unit 152 may be, for example, a syringe pump.

The voltage supply unit 153 may apply a voltage to the conductive tip 1513 disposed within the capillary nozzle 151. In detail, the voltage supply unit 153 may apply a voltage to the tip 1513 through the conductive body segment 1511 and the conductive fixing member 1514. In some embodiments, the voltage supply unit 153 may provide the tip 1513 with a voltage in the range, but not limited to, from about 3 kV to about 9 kV. The voltage supply unit 153 may apply a direct voltage or an alternating voltage.

An electric filed may be produced by the tip 1513 that is supplied with a voltage from the voltage supply unit 153. The electric field produced by the tip 1513 may affect between the polishing pad 140 and the capillary nozzle 151. In other words, an electric field may also be produced between the polishing pad 140 and the capillary nozzle 151. In some embodiments, the electric field produced by the tip 1513 produced by the tip 1513 may build a pin-to-plate electrode structure. The pin-to-plate electrode structure may produce an electric field whose magnitude is greater than that of an electric field produced at a plate-to-plate or ring-to-plate electrode structure.

The slurry S in the capillary nozzle 151 may be charged by the tip 1513 supplied with a voltage. The slurry S in the capillary nozzle 151 may be charged more efficiently when a voltage is applied to the tip 1513 than when a voltage is applied only to the body segment 1511.

The electric field produced by the tip 1513 may provide the charged slurry S with an electric force. The electric force may pull the charged slurry S toward the polishing pad 140. The charged slurry S may then be electro-hydrodynamically sprayed toward the polishing pad 140 from the capillary nozzle 151.

The voltage supply unit 153 may include a high power supply (not shown) and a function generator (not shown). The high power supply may produce a high voltage. For example, the high power supply may produce a voltage ranging up to about 10 kV. A frequency, a duty cycle and an amplitude of a pulse wave may be adjusted by and/or output from the function generator.

It will be herein discussed about an operation of the slurry supply device 150 constructed as stated above according to example embodiments of the inventive concepts.

Figure 4:
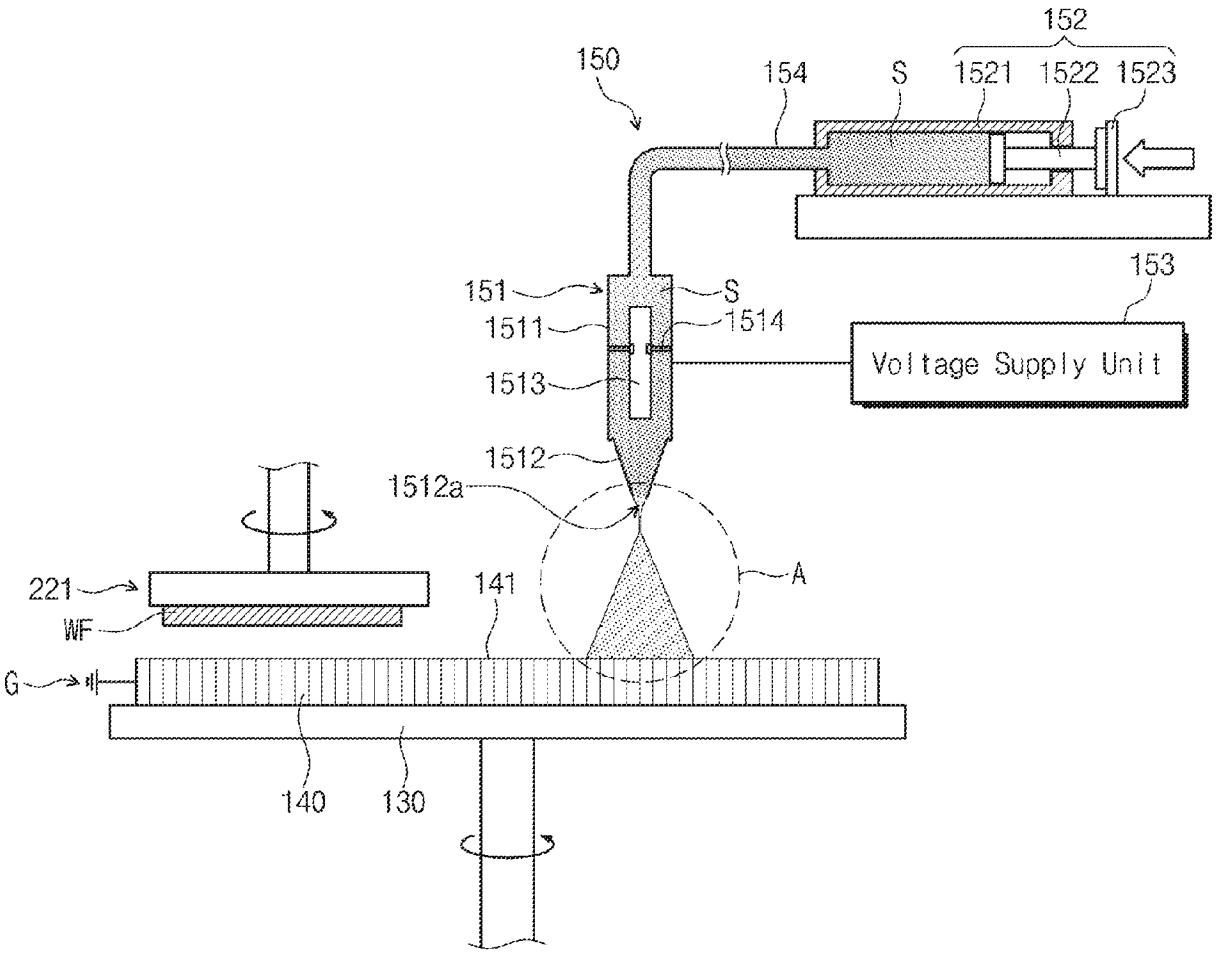
FIG. 4 is a schematic diagram for explaining an operation of the slurry supply device of FIG. 3A.
Figure 5:
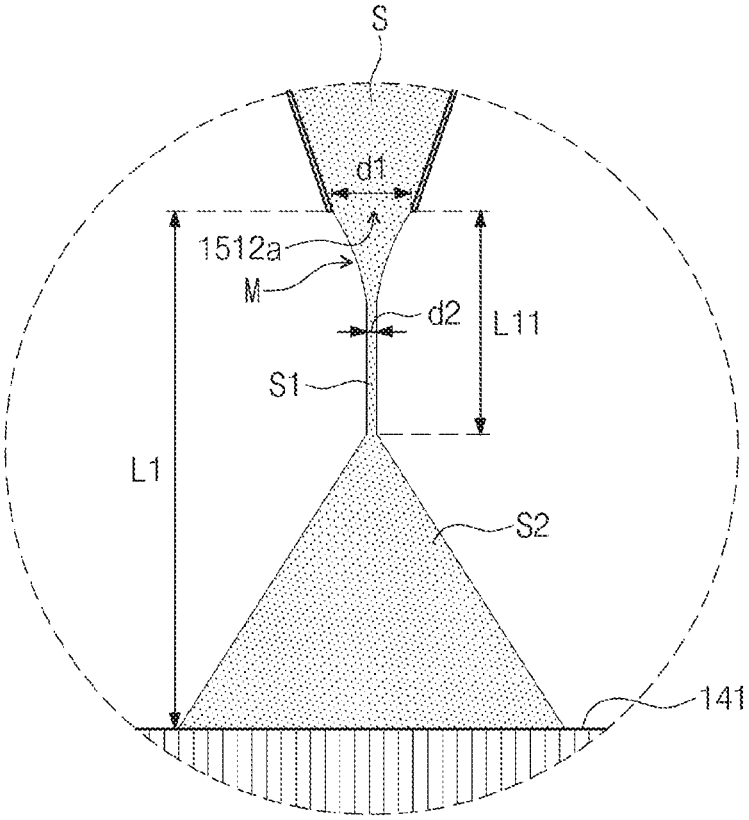
FIG. 5 is an enlarged view of section A shown in FIG. 4.

FIG. 4 is a schematic diagram for explaining an operation of the slurry supply device of FIG. 3A. FIG. 5 is an enlarged view of section A shown in FIG. 4.

Referring to FIGS. 3A to 5, the slurry supply unit 152 may supply the capillary nozzle 151 with the slurry S at a flow rate in the range from about 2 μl/min to about 8 μl/min. In this case, a surface tension of the slurry S in the capillary nozzle 151 may not spray the slurry S through the jetting hole 1512*a*.

When the voltage supply unit 153 applies to a voltage to the tip 1513 of the capillary nozzle 151, the slurry S in the capillary nozzle 151 may be charged and an electrical field may be produced between the capillary nozzle 151 and the polishing pad 140.

The charged slurry S may be provided with an electrical force of the electrical field. The electric force provided to the charged slurry S may concentrate electric charges on a surface of the charged slurry S. The electric force provided to the charged slurry S may thus become greater by the Coulomb force.

As the electric force provided to the charged slurry S becomes greater, a sum of the electric force and a hydraulic pressure of the slurry S supplied into the capillary nozzle 151 may become greater than the surface tension of the slurry S. The capillary nozzle 151 may therefore electro-hydrodynamically spray the slurry S through the jetting hole 1512*a*. As a result, the slurry supply device 150 may exactly provide the slurry S by a desired amount. The electric force may be proportional to a value of the voltage applied to the tip 1513.

The capillary nozzle 151 may spray the slurry S in various modes depending on a value of the voltage applied to the tip 1513. The aforementioned modes may include a micro dripping mode, a cone jet mode, and a ramified jet mode. As a value of the voltage applied to the tip 1513 becomes greater, the capillary nozzle 151 may spray the slurry S in the micro dripping mode, the cone jet mode, and the ramified jet mode in the foregoing sequence. For example, the slurry S may be sprayed in the micro dripping mode, the cone jet mode, and the ramified jet mode when the tip 1513 is supplied with a smaller voltage, an intermediate voltage, and a larger voltage, respectively.

The followings are descriptions about the spray modes mentioned above. In the micro dripping mode, the capillary nozzle 151 may spray the slurry S in the form of micro-droplets. In detail, the slurry S in the capillary nozzle 151 may be charged by a first voltage (e.g., ranging from about 1 kV to about 2 kV) applied to the capillary nozzle 151. The charged slurry S may form a hemispherical meniscus by an electric force. The charged slurry S may drop in the form of micro-droplets from a bottom end of the meniscus. The micro-droplets may have a spherical shape and be sprayed at a regular interval. The interval may be adjusted by the function generator (not shown). The micro-droplet may have a diameter much less than the diameter d1 of the jetting hole 1512*a*. For example, the micro-droplet may have a diameter of about several tens of μm.

In the cone jet mode, the capillary nozzle 151 may spray the slurry S in the form of a straight line. In detail, the slurry S in the capillary nozzle 151 may be charged by a second voltage (e.g., ranging from about 2 kV to about 3 kV) applied to the capillary nozzle 151. The second voltage may be greater than the first voltage. The charged slurry S may form a conical meniscus by an electric force. For example, the meniscus may be provided to have a conical shape whose diameter decreases with increasing distance from the jetting hole 1512*a*. The charged slurry S may be sprayed in the form of a straight line from a bottom end of the meniscus. The slurry sprayed in the form of a straight line may have a diameter much less than the diameter d1 of the jetting hole 1512*a*. For example, the slurry sprayed in the form of a straight line may have a diameter of about several tens of μm.

Referring to FIG. 5, in the ramified jet mode, the slurry S in the capillary nozzle 151 may be sprayed in the form of a straight line in advance and then may spread in the form of micro-droplets. In detail, the slurry S in the capillary nozzle 151 may be charged by a third voltage (e.g., ranging from about 3 kV to about 9 kV) greater than the second voltage. The charged slurry S may form a conical meniscus M by an electric force. For example, the meniscus M may be provided to have a conical shape whose diameter rapidly decreases with increasing from the jetting hole 1512*a*. The charged slurry S may be sprayed in the form of a straight line (referred to hereinafter as a linear slurry S1) up to a first distance L11 from a bottom end of the meniscus M. The linear slurry S1 may have a diameter d2 much less than the diameter d1 of the jetting hole 1512*a*. For example, the linear slurry S1 may have a diameter d2 of about several tens of μm. The linear slurry S1 may radially spread in the form of micro-droplets (referred to hereinafter as a droplet slurry S2) after passing over the first distance L11. Thus, the slurry S may be sprayed to obtain a deposition area greater in the ramified jet mode than in the dripping or cone jet mode. In this description, the deposition area may mean an area formed when the slurry S drops onto the polishing pad 140. the first distance L11 may mean a distance between the jetting hole 1512*a* and a point at which the linear slurry S1 is changed into the droplet slurry S2.

The linear slurry S1 may be changed into the droplet slurry S2 after passing over the first distance L11 originating from the bottom end of the capillary nozzle 151, so that it may be essential that the capillary nozzle 151 be spaced apart from the polishing pad 140 by a first spacing L1 over a certain distance. For example, it may be necessary that the first spacing L1 be greater than the first distance L11. If however the first spacing L1 is much larger, a dropping distance (not designated by the reference numeral) of the droplet slurry S2 may be much increased. Therefore, an insufficient amount of the droplet slurry S2 may drop onto the top surface 141 of the polishing pad 141 owing to external environment. If, on the other hand, the first spacing L1 is much less, the dropping distance of the droplet slurry S2 may be much decreased. In this description, the dropping distance may be a difference between the first spacing L1 and the first distance L11. Therefore, the droplet slurry S2 may drop to form the deposition area that is much less than expected. In conclusion, when the capillary nozzle 151 sprays the slurry S in the ramified jet mode, it may be desirable that the first spacing L1 is in an appropriate range.

In some embodiments, the capillary nozzle 151 may spray the slurry S in the ramified jet mode under the condition that the capillary nozzle 151 is supplied with a voltage in the range from about 3 kV to about 9 kV, the first spacing L1 is in the range from about 2 cm to about 9 cm, and the capillary nozzle 151 is supplied with the slurry S at a flow rate of from about 2 μl/min to about 8 μl/min. For example, the capillary nozzle 151 may spray the slurry S in the ramified jet mode under the condition that the voltage is about 6 kV, the flow rate of the slurry S is about 7 μl/min, and the first spacing L1 is about 4 cm. In the ramified jet mode, the slurry S may spray to form a deposition area of about 176.625 $cm^2$.

In the micro dripping mode, the cone jet mode, and the ramified jet mode, the meniscus may be exposed to outside the capillary nozzle 151 through the jetting hole 1512*a*.

Figure 6:
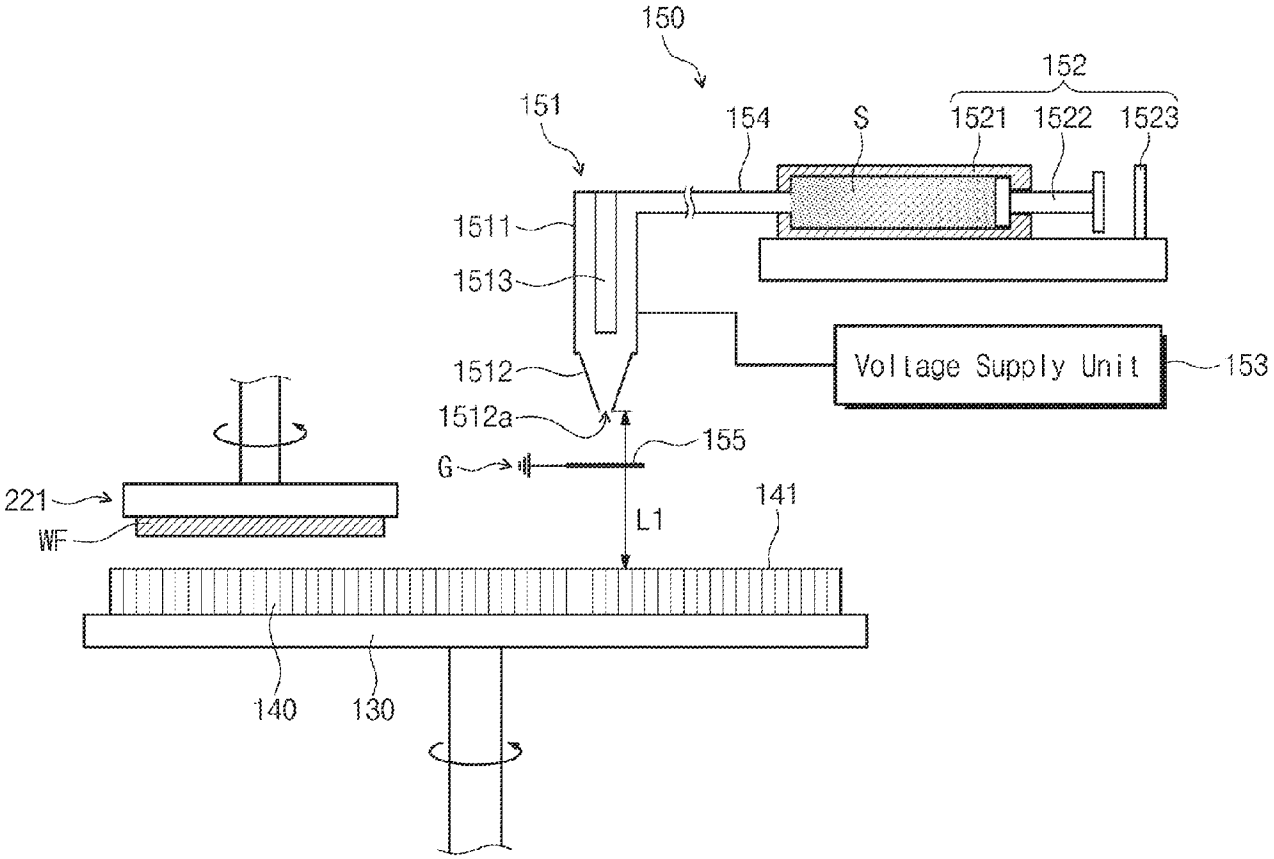
FIG. 6 is a schematic diagram for explaining a slurry supply device according to example embodiments of the inventive concepts.
Figure 7:
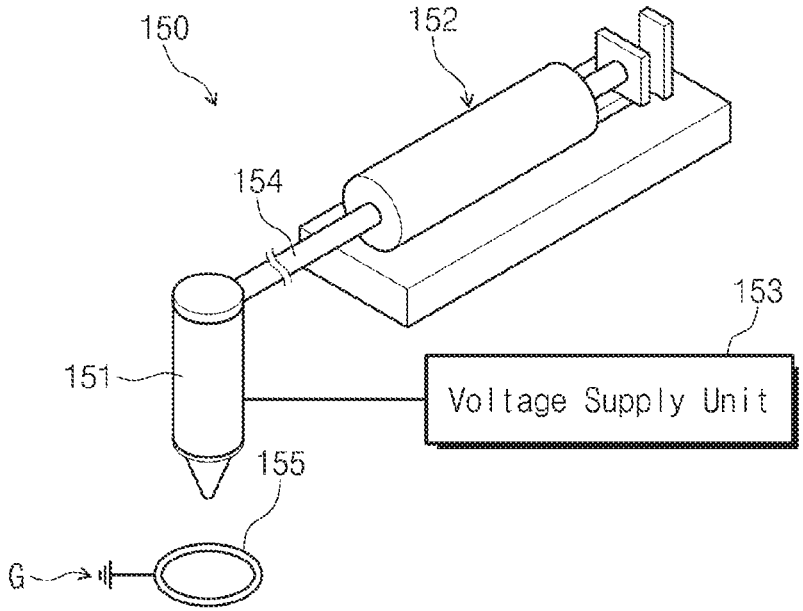
FIG. 7 is a perspective view for explaining the slurry supply device of FIG. 6.

FIG. 6 is a schematic diagram for explaining a slurry supply device according to example embodiments of the inventive concepts. FIG. 7 is a perspective view for explaining the slurry supply device of FIG. 6.

A slurry supply device 150 shown in FIGS. 6 and 7 are similar to or the same as that (refer to the reference numeral 150 of FIG. 3A) discussed with reference to FIGS. 3A to 5. For the sake of simplification, the description about substantially the same configuration will be omitted or roughly described, and different configurations will be mainly discussed in detail.

Referring to FIGS. 6 and 7, the slurry supply device 150 may include the capillary nozzle 151, the slurry supply unit 152, and the voltage supply unit 153. In an embodiment, the polishing pad 140 may be insulative. The tip 1513 may produce an electric field between the capillary nozzle 151 and the polishing pad 140, and the electric field may have a reduced magnitude compared with the case that the polishing pad 140 is conductive. Differently from the slurry supply device 150 of FIG. 3A, the slurry supply device 150 may further include a conducive member 155 between the capillary nozzle 151 and the polishing pad 140 so as to reinforce a magnitude of the electric field. Thus, the capillary nozzle 151 may electro-hydrodynamically spray the slurry S charged by the tip 1513.

The conductive member 155 may be provided between the capillary nozzle 151 and the polishing pad 140. The conductive member 155 may have a ring shape. In some embodiments, the conductive member 155 may be shaped like a circular ring, but not limited thereto, or alternatively a polygonal ring such as a rectangular ring. In addition, the conductive member 155 may be earthed to a ground G.

Differently from the capillary nozzle 151 discussed in FIG. 3A, the capillary nozzle 151 may not include a fixing member (refer to the reference numeral 1514 of FIG. 3A). The tip 1513 may include a portion connected to the body segment 1511. In detail, an adhesive (not shown) may be provided to adhere the portion of the tip 1513 to an upper inner surface of the body segment 1511. An interconnect pipe 154 may be provided connected to a side of the body segment 1511.

The slurry supply device 150 may further include a moving unit (not shown) for moving the capillary nozzle 151. The moving unit may move the capillary nozzle 151 along an imaginary line (not shown) running across a center of the polishing pad 140. The imaginary line may be either a straight line or a curved line. The moving unit may drive to move the capillary nozzle 151 straightly or curvedly over the top surface 141 of the polishing pad 140. As the capillary nozzle 151 moves over the top surface 141 of the polishing pad 140, the slurry S may uniformly drop onto the top surface 141 of the polishing pad 140. The moving unit may also drive to move the capillary nozzle 151 along a vertical direction. Therefore, the capillary nozzle 151 may move toward or away from the polishing pad 140.

Figure 8:
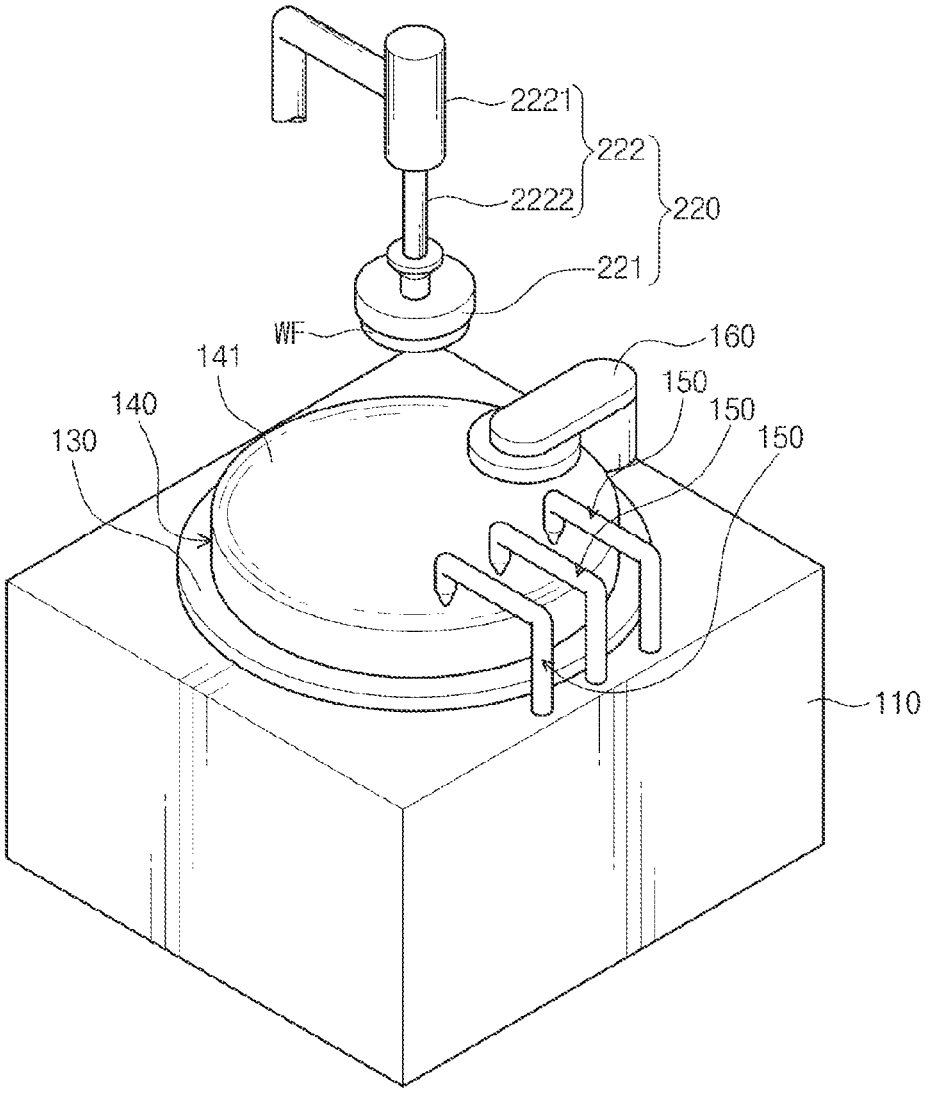
FIG. 8 is a perspective view for explaining an example of a chemical mechanical polishing apparatus according to example embodiments of the inventive concepts.
Figure 9:
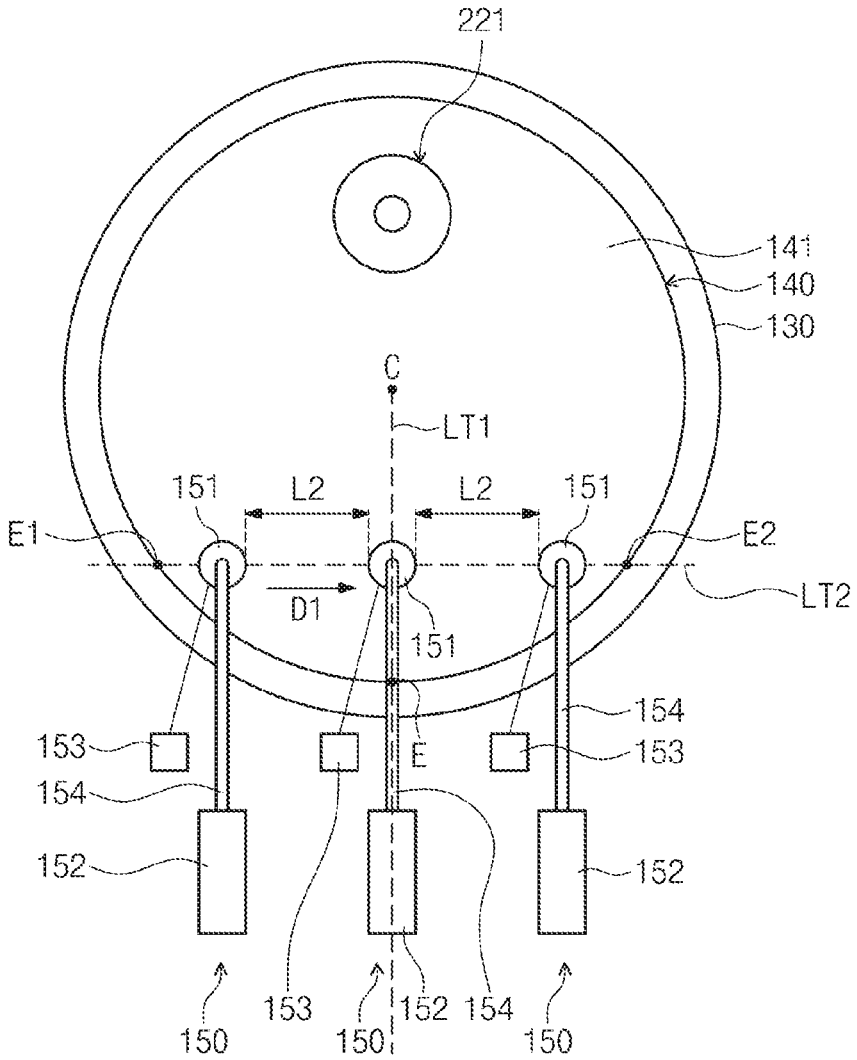
FIG. 9 is a schematic diagram for explaining a plurality of slurry supply devices included in the chemical mechanical polishing apparatus shown in FIG. 8.

FIG. 8 is a perspective view for explaining an example of a chemical mechanical polishing apparatus according to example embodiments of the inventive concepts. FIG. 9 is a schematic diagram for explaining a plurality of slurry supply devices included in the chemical mechanical polishing apparatus shown in FIG. 8. Configurations of the chemical mechanical polishing apparatus shown in FIGS. 8 and 9 are similar to or the same as those of the chemical mechanical polishing apparatus discussed with reference to FIGS. 2 and 3A, and thus the description about the same configuration will be omitted or roughly described and different configurations will be mainly described in detail.

Referring to FIGS. 8 and 9, the chemical mechanical polishing apparatus 10 may include the lower base 110, the load cup 120, the platen 130, the polishing pad 140, the pad conditioner 160, the slurry supply device 150, and the carrier head assembly 200.

The slurry supply device 150 may include the capillary nozzle 151, the slurry supply unit 152, and the voltage supply unit 153. The slurry supply device 150 may be provided in plural. The polishing pad 140 may then be rapidly supplied with a slurry (refer to the reference symbol S of FIG. 3A), so that it may be possible to enhance the speed of a polishing process.

The capillary nozzles 151 of the slurry supply devices 150 may be disposed over and spaced apart from the polishing pad 140. Electric fields may be respectively produced between the capillary nozzles 151 and the polishing pad 140. The capillary nozzles 151 may be disposed spaced apart from each other by a second spacing L2 in such a way that the electric fields produced by the capillary nozzles 151 may not affect each other. In some embodiments, the second spacing L2 may be in the range of about 5 cm or more.

The capillary nozzles 151 may be spaced apart over the polishing pad 140 along a single direction D1 substantially parallel to the top surface 141 of the polishing pad 140. In some embodiments, the capillary nozzles 151 may be substantially straightly spaced apart along a second imaginary straight line LT2 connecting a first edge E1 to a second edge E2 of the polishing pad 140 that are oppositely disposed across a first imaginary straight line LT1 connecting a center C to an edge E of the polishing pad 140. The second imaginary straight line LT2 may be perpendicular to the first imaginary straight line LT1, and the first edge E1 may be symmetric to the second edge E2 around the first imaginary straight line LT1.

An angle less than about 180° may be made between a third imaginary straight line (not shown) connecting the center C to the first edge E1 and a fourth imaginary straight line (not shown) connecting the center C to the second edge E2. In some embodiments, the first and second imaginary straight lines LT1 and LT2 may be substantially parallel to the top surface 141 of the polishing pad 140. The third and fourth imaginary straight lines (not shown) may also be substantially parallel to the top surface 141 of the polishing pad 140.

The capillary nozzles 151 may be spaced apart from the polishing pad 140 by a first spacing (refer to the reference symbol L1 of FIG. 3A). In some embodiments, the capillary nozzles 151 may be equally spaced apart from the polishing pad 140 by the first spacing L1. Alternatively, in other embodiments, at least one of the capillary nozzles 151 may be spaced apart from the polishing pad 140 by a spacing different from the first spacing L1.

Figure 10:
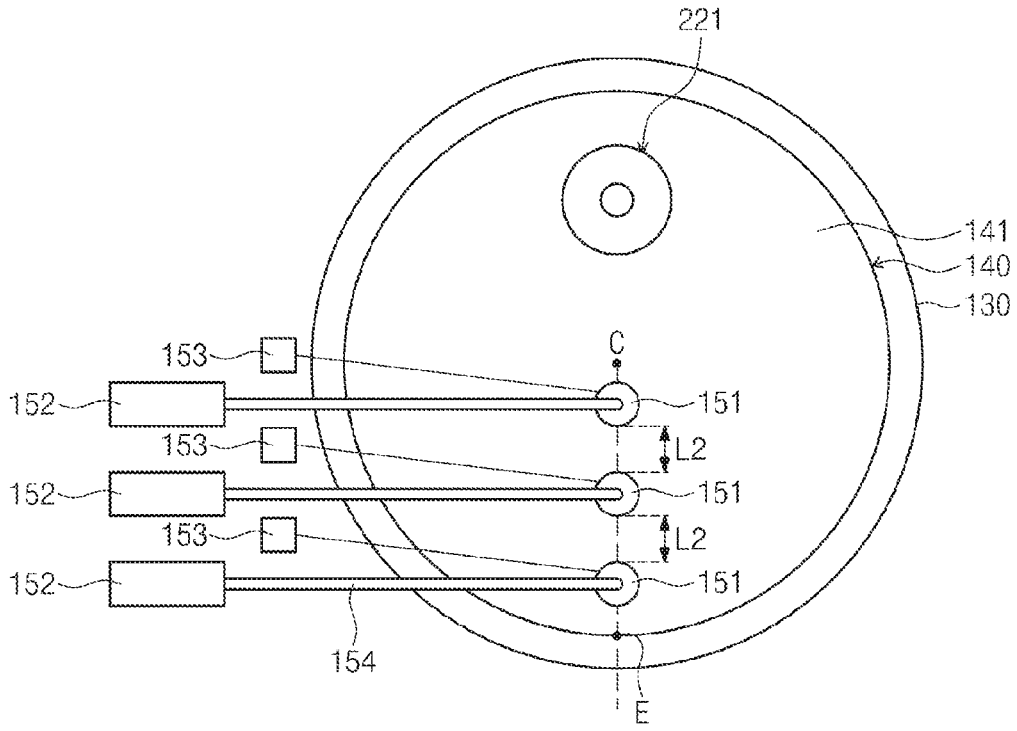
FIGS. 10 and 11 are schematic diagrams for explaining other examples of the slurry supply devices of the chemical mechanical polishing apparatus shown in FIG. 8.
Figure 11:
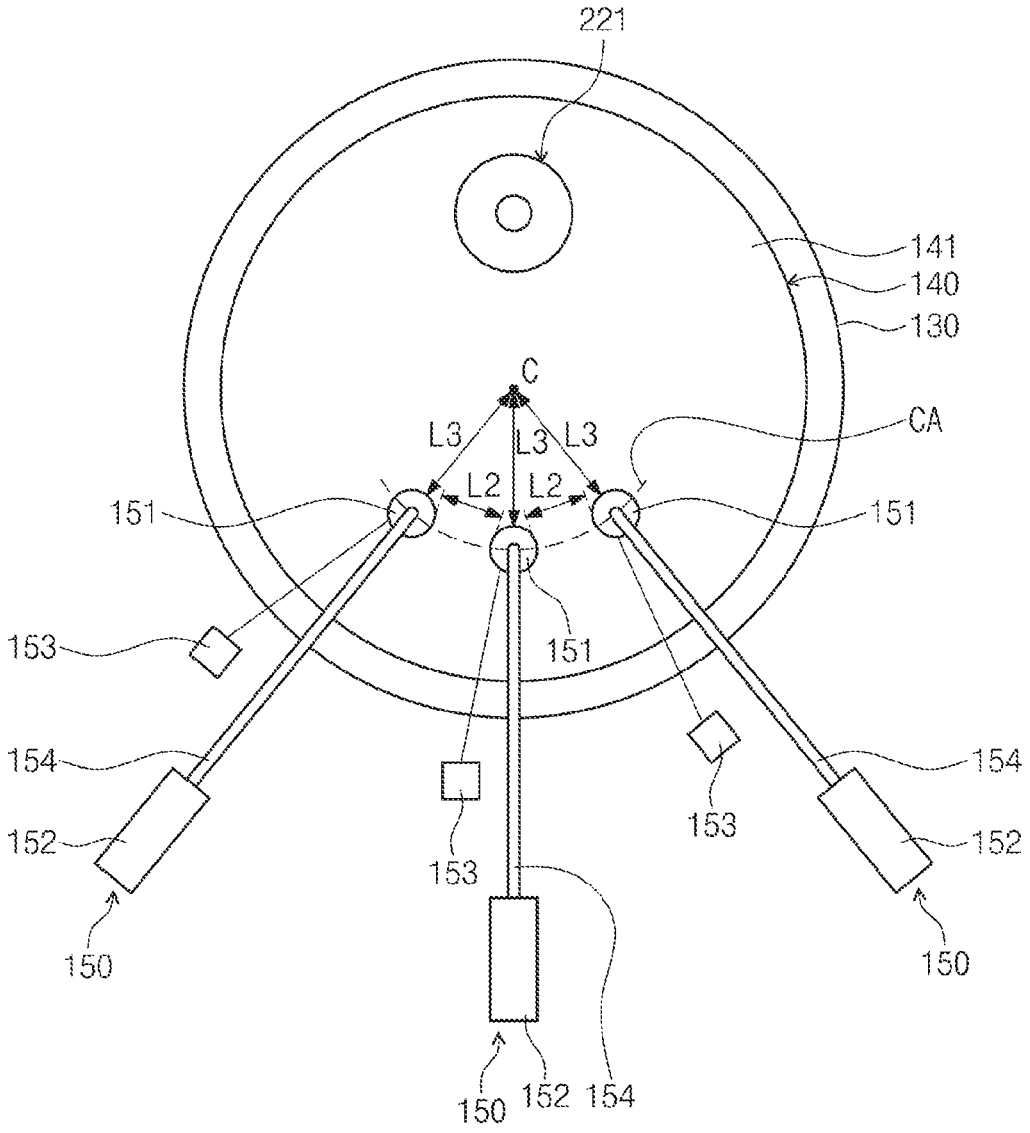

FIGS. 10 and 11 are schematic diagrams for explaining other examples of the slurry supply devices of the chemical mechanical polishing apparatus shown in FIG. 8. Configurations of the chemical mechanical polishing apparatus shown in FIGS. 10 and 11 are similar to or the same as those of the chemical mechanical polishing apparatus discussed with reference to FIGS. 2 and 3A, and thus the description about the same configuration will be omitted or roughly described and different configurations will be mainly described in detail.

Referring to FIG. 10, the slurry supply device 150 may be provided in plural. In some embodiments, the capillary nozzles 151 may be provided spaced apart along the first imaginary straight line LT1 connecting the center C to the edge E of the polishing pad 140. The capillary nozzles 151 may be adjacently disposed spaced apart from each other by the second spacing L2. Alternatively, in certain embodiments, capillary nozzles 151 may be spaced apart along an imaginary curved line (not shown) connecting the center C to the edge E of the polishing pad 140. The imaginary curved line may be disposed on the polishing pad 140.

Referring to FIG. 11, the slurry supply device 150 may be provided in plural. The capillary nozzles 151 may be spaced apart along an imaginary arc CA. In this description, the imaginary arc CA may refer to a curved line in which all points are the same distance from the center C of the polishing pad 140. The capillary nozzles 151 may be disposed spaced apart from the center of the polishing pad 140 by a third spacing L3. The capillary nozzles 151 may be disposed over the top surface 141 of the polishing pad 140. The capillary nozzles 151 may be adjacently disposed spaced apart from each other by the second spacing L2.

In some embodiments, the carrier head 221 may be disposed spaced apart from the center of the polishing pad 140 by the third spacing L3. The carrier head 221 may be disposed on an imaginary circumference (not shown) extending from the imaginary arc CA. Therefore, the polishing pad 140 may have a contact area in contact with a wafer that is picked up by the carrier head 221, and the slurry supply devices 150 may supply the slurry concentrated on the contact area of the polishing pad 140.

It will be discussed about a chemical mechanical polishing process using the chemical mechanical polishing equipment (refer to the reference numeral 1 of FIG. 1) constructed as stated above according to example embodiments of the inventive concepts.

Referring to FIGS. 1 to 5, the carrier head 221 may pick up the wafer WF disposed on the load cup 120. The wafer WF may include a plurality of semiconductor devices. Each of the plurality of semiconductor devices may include a substrate and a plurality of layers. The plurality of layers may include an insulative layer, a barrier layer, and a conductive layer. The insulative layer may have a via hole therein, and the barrier layer may be formed conformally on the via hole and an upper portion of the insulative layer. The conductive layer may be disposed on the barrier layer while filling the via hole The carrier head 221 may place the wafer WF onto the platen 130 (referred to hereinafter as a first platen) adjacent to the load cup 120 along a counterclockwise direction. In this case, the wafer WF may be placed such that its polishing target surface faces the top surface 141 of the polishing pad 140 (referred to hereinafter as a first polishing pad) on the first platen 130. The first polishing pad 140 may rotate driven by the first platen 130.

Each of the plurality of slurry supply devices 150 may supply the slurry S to the top surface 141 of the first polishing pad 140. In some embodiments, the slurry supply unit 152 may supply the capillary nozzle 151 with the slurry S at a flow rate of about 7 μl/min or less. The first spacing L1 of about 4 cm may be between the bottom end of the capillary nozzle 151 and the top surface 141 of the first polishing pad 140. In addition, the voltage supply unit 153 may apply a voltage of about 6 kV to the conductive tip 1513 in the capillary nozzle 151, and therefore the capillary nozzle 151 may electro-hydrodynamically spray the slurry S.

For example, when a voltage is applied to the conductive tip 1513, the slurry S in the capillary nozzle 151 may be charged and an electric field may be produced between the capillary nozzle 151 and the top surface 141 of the first polishing pad 140. An electric force of the electric field may force the charged slurry S to jet out of the capillary nozzle 151 through the jetting hole 1512*a*. A conical meniscus M may be formed from the slurry S flowed out of the jetting hole 1512*a*. The charged slurry S may be sprayed from a bottom end of the meniscus M by the electric force. The slurry S may drop onto the top surface 141 of the first polishing pad 140. The dropped slurry S may form a deposition area of about 176 cm2. A single slurry supply device 150 may supply the first polishing pad 140 with the slurry S of about 0.5 l or more for about 90 seconds. In some embodiments, the first polishing pad 140 may be supplied with the slurry S from three slurry supply devices 150. Thus, the three slurry supply devices 150 may supply the first polishing pad 140 with the slurry S of about 1.5 l or more for about 90 seconds.

Alternatively, in other embodiments, the tip 1513 may be supplied with a voltage of about 5.5 kV, the capillary nozzle 151 may be supplied with the slurry S at a flow rate of about 5 μl/min, and the first spacing L1 may be about 5 cm. In this case, the deposition area may be about 78.5 cm2 and a single slurry supply device 150 may supply the top surface 141 of the first polishing pad 140 with the slurry S of about 0.250 or more for about 90 seconds.

When the slurry S is supplied to the first polishing pad 140, the carrier head 221 may rotate while pressing the polishing target surface of the wafer WF against the top surface 141 of the first polishing pad 140. The first polishing pad 140 may therefore polish the wafer WF. In some embodiments, the chemical mechanical polishing apparatus 10 may polish most of the conductive layer.

The carrier head 221 may move onto a platen (referred to hereinafter as a second platen) adjacent to the first platen 130 along the counterclockwise direction. In this case, the wafer WF may be placed such that its polishing target surface faces a top surface of a polishing pad (referred to hereinafter as a second polishing pad) on the second platen. The second platen may rotate the second polishing pad.

When the slurry S is supplied to the top surface of the second polishing pad, the carrier head 221 may rotate while pressing the polishing target surface of the wafer WF against the top surface of the second polishing pad. The second polishing pad may therefore polish the wafer WF. In some embodiments, the chemical mechanical polishing apparatus 10 may polish the conductive layer and expose the barrier layer.

The carrier head 221 may move onto a platen (referred to hereinafter as a third platen) adjacent to the second platen along the counterclockwise direction. In this case, the wafer WF may be placed such that its polishing target surface faces a top surface of a polishing pad (referred to hereinafter as a third polishing pad) on the third platen. The third platen may rotate the third polishing pad.

When the slurry S is supplied to the top surface of the third polishing pad, the carrier head 221 may rotate while pressing the polishing target surface of the wafer WF against the top surface of the third polishing pad. The third polishing pad may therefore polish the wafer WF. In some embodiments, the chemical mechanical polishing apparatus 10 may polish the barrier layer on the upper portion of the insulative layer.

The carrier head 221 may move onto the load cup 120 adjacent to the third platen along the counterclockwise direction. The carrier head 221 may place the polished wafer WF back on the load cup 120.

According to example embodiments of the inventive concept, a specific area of the polishing pad may be supplied with an appropriate amount of the slurry. It may thus be possible to minimize the slurry loss and reduce the processing cost.

An effect of the inventive concepts are not limited to the above-mentioned one, other effects which have not been mentioned above will be clearly understood to those skilled in the art from the following claims.

Although the example embodiments have been described in connection with the embodiments of the inventive concept illustrated in the accompanying drawings, it will be understood by one of ordinary skill in the art that variations in form and detail may be made therein without departing from the spirit and essential features of the inventive concepts. The above disclosed embodiments should thus be considered illustrative and not restrictive.

What is claimed is:

1. A chemical mechanical polishing apparatus, comprising:

a lower base;

a platen provided on a top surface of the lower base and configured to rotate;

a polishing pad on the platen; and at least one slurry supply device adjacent to the polishing pad, wherein the at least one slurry supply device includes:

a capillary nozzle over the polishing pad, the capillary nozzle including a pin-type conductive tip therein;

a slurry supply unit configured to supply a slurry into the capillary nozzle; and a voltage supply unit configured to apply a voltage to the pin-type conductive tip.

2. The apparatus of claim 1, wherein the capillary nozzle is configured to electro-hydrodynamically spray the slurry out of the capillary nozzle using a voltage applied to the pin-type conductive tip from the voltage supply unit.

3. The apparatus of claim 2, wherein the voltage supply unit is configured to supply the pin-type conductive tip with a voltage ranging from about 3 kV to about 9 kV.

4. The apparatus of claim 1, wherein a bottom end of the capillary nozzle and a top surface of the polishing pad are spaced apart in a first spacing, the first spacing being in a range from about 2 cm to about 9 cm.

5. The apparatus of claim 1, wherein the polishing pad is configured to be electrically connected to a ground.

6. The apparatus of claim 1, further comprising a ring-type conductive member between the polishing pad and the capillary nozzle.

7. The apparatus of claim 1, wherein the slurry supply unit includes a syringe pump.

8. The apparatus of claim 1, wherein the at least one slurry supply device includes a first slurry supply device and a second slurry supply device, the first slurry supply device includes a first capillary nozzle, the second slurry supply device includes a second capillary nozzle, and wherein the first capillary nozzle and the second capillary nozzle are adjacent to each other and are spaced apart from each other by a spacing.

9. The apparatus of claim 8, wherein the spacing is in a range of about 5 cm or more.

10. The apparatus of claim 8, wherein the first capillary nozzle and the second capillary nozzle are spaced apart above the polishing pad along a direction substantially parallel to a top surface of the polishing pad.

11. A chemical mechanical polishing apparatus, comprising:

a lower base;

a platen provided on a top surface of the lower base and configured to rotate;

a polishing pad on the platen; and at least one slurry supply device adjacent to the polishing pad wherein the at least one slurry supply device includes;

a capillary nozzle over and spaced apart from the polishing pad;

a slurry supply unit configured to supply a slurry into the capillary nozzle; and a voltage supply unit configured to apply a voltage to the capillary nozzle, wherein the capillary nozzle is configured to electro-hydrodynamically spray the slurry out of the capillary nozzle.

12. The apparatus of claim 11, wherein the capillary nozzle includes a conductive tip having a pin shape, the voltage supply unit is configured to supply the conductive tip with a voltage ranging from about 3 kV to about 9 kV, and a bottom end of the capillary nozzle and a top surface of the polishing pad are spaced apart from each other in a range from about 2 cm to about 9 cm.

13. The apparatus of claim 11, further comprising a ring-type conductive member between the polishing pad and the capillary nozzle.

14. The apparatus of claim 11, wherein the at least one slurry supply device includes a first slurry supply device and a second slurry supply device, the first slurry supply device includes a first capillary nozzle, the second slurry supply device includes a second capillary nozzle, and the first capillary nozzle and the second capillary nozzle are adjacent to each other and are spaced apart from each other by a spacing.

15. The apparatus of claim 14, wherein the spacing is in a range of about 5 cm or more.

16. A slurry supply device for supplying slurry onto a polishing pad comprising:

a capillary nozzle including a pin-type conductive tip and a jetting hole, the jetting hole configured to be over and spaced apart from the polishing pad by between 2 cm to 9 cm;

a slurry supply unit configured to supply slurry into the capillary nozzle; and a voltage supply unit configured to apply a voltage to the pin-type conductive tip.

17. The slurry supply device of claim 16, wherein the slurry supply unit is configured to supply the capillary nozzle with slurry at a flow rate of about 2 microliters per minute to about 8 microliters per minute, and wherein the voltage supply unit is configured to supply the pin-type conductive tip with a voltage of between 3 kV to 9 kV.

18. The slurry supply device of claim 16, wherein the capillary nozzle further includes a nozzle segment, wherein the nozzle segment is substantially conical in shape.

19. The slurry supply device of claim 18, wherein the capillary nozzle further includes a body segment, wherein the body segment is conductive.

20. The slurry supply device of claim 16, wherein the voltage supply unit is configured to supply a direct voltage or an alternating voltage.

* * * * *